US005439181A

United States Patent [19]

Williams

[11] Patent Number: 5,439,181

[45] Date of Patent: Aug. 8, 1995

[54] CHEVRON DEVICE LIMITING MILL DISCHARGE IN A FLUID BED SYSTEM

[76] Inventor: Robert M. Williams, 16 La Hacienda, Ladue, Mo. 63124

[21] Appl. No.: 320,108

[22] Filed: Sep. 29, 1994

Related U.S. Application Data

[63] Continuation of Ser. No. 214,988, Mar. 21, 1994, abandoned.

[51] Int. Cl.[6] ..... B02C 23/08

[52] U.S. Cl. ..... 241/79.1; 241/53

[58] Field of Search ..... 241/48, 52, 53, 57, 241/58, 60, 61, 79, 79.1, 97

[56] References Cited

U.S. PATENT DOCUMENTS

| | | | |
|---|---|---|---|
| 1,583,429 | 5/1926 | Stein . | |
| 2,050,423 | 8/1936 | Dauber | 241/52 |
| 2,546,286 | 3/1951 | Zakel | 241/52 X |
| 2,931,581 | 4/1960 | Lykken et al. | 241/52 |
| 3,794,251 | 2/1974 | Williams | 241/65 |
| 3,826,208 | 7/1974 | Williams | 110/15 |
| 3,887,141 | 6/1975 | Francis | 241/52 |
| 4,498,633 | 2/1985 | Williams | 241/48 |
| 4,566,639 | 1/1986 | Williams | 241/52 |
| 4,641,788 | 2/1987 | Williams | 241/14 |

FOREIGN PATENT DOCUMENTS

| | | | |
|---|---|---|---|
| 218347 | 11/1961 | Austria | 241/52 |
| 630671 | 12/1927 | France | 241/52 |
| 699178 | 10/1940 | Germany | 241/79.1 |
| 1487977 | 6/1989 | U.S.S.R. | 241/79.1 |

*Primary Examiner*—Timothy V. Eley
*Attorney, Agent, or Firm*—Polster, Lieder, Woodruff & Lucchesi

[57] ABSTRACT

Apparatus for reducing the particle size of material subjected to the impact of the hammers of a material reducing hammer mill in which oversize material impacted by the mill hammer is prevented from getting into the stream of properly sized material by being thrown against a flow impeding member which makes such material difficult to pass a material sizing fan having spinner blades that can not effectively intercept particles that are hard, improperly reduced, and require reduction. Material flow impeding angular passages which offer resistance to flow of material that is hard and/or oversized are located to intercept the oversized material and return such material to the material reducing hammer mill for further size reduction before it is able to get into the product stream.

1 Claim, 1 Drawing Sheet

CHEVRON DEVICE LIMITING MILL DISCHARGE IN A FLUID BED SYSTEM

This is a continuation of application Serial No. 08/214,988, filed Mar. 21, 1994, now abandoned.

BACKGROUND OF THE INVENTION

1. Field of the Invention

The invention is concerned with a chevron device limiting mill discharge in a fluid bed system which receives material in a coarse condition and reduce the material to a substantial uniform size dictated by the chevron device for subsequent use.

2. Description of the Prior Art

In the field of the invention apparatus is known to be able to pulverize material in a constant ventilation system so that material particles are released for collection when they reach a required degree of fineness. Such apparatus is disclosed in U.S. Pat. No. 1,583,429 of May 4, 1926. This apparatus was followed by a forced circulation material classifier having a rotary mill having flat blades for pulverizing material, as shown in U.S. Pat. No. 2,931,581 of Apr. 5, 1960. In this type of apparatus the reduced material is delivered out of the closed mill through a venturi throat by fan action as in U.S. Pat. No. 4,566,639 of Jan. 28, 1986.

In later material reduction apparatus having impact hammer rotors, the material to be reduced enters into a closed hammer rotor chamber through a venturi which functions both as an inlet for material to be reduced and as an outlet for the reduced material. Such apparatus is known in U.S. Pat. Nos. 3,794,251 of Feb. 26, 1974 and U.S. Pat. No. 3,826,208 of Jul. 30, 1974.

Further types of apparatus operate to extract hard to grind material from the fractions that are reduced to a fineness of useful size, as in U.S. Pat. No. 4,498,633 of Feb. 12, 1985. In this class of apparatus there is disclosed an impact mill for processing two different types of material and forming a bed of material in the bottom of the mill chamber to collect material that is relatively soft to minimize the production of fines in the outgoing material from the mill of U.S. Pat. No. 4,641,788 of Feb. 10, 1987.

The problem in the apparatus of the prior art is that where a rotary hammer mill is employed the larger and/or heavier particles of the material being processed for reduction fly off the hammers at a velocity approaching the tip speed of the mill hammers and this improperly sized material gets into the stream of properly reduced material. Such larger and/or heavier particles act also with a force in which damage can result. A further problem with the prior art apparatus is that the air moving fan devices when located in the outlets are not protected from being impacted by the fractions of the harder and heavier material thrown out by the mill hammers.

BRIEF SUMMARY OF THE INVENTION

The apparatus herein is operative to handle hard to reduce material such as limestone or coal by subjecting that material to an impact mill for its reduction to a desired size reduction.

It is an object to provide a system which prevents a mill from being able to throw hard to reduce material into the mill outlet in a fluid bed system that is dependent on air impelled material flow.

A further object is to reduce material to a desired particle size by means in an impact mill outlet that limits the size of particles allowed to exit at the mill outlet.

Another is to provide an impact mill outlet with a particle size limiting means so that oversize particles are retained for further reduction while material responsive to air flow is released.

A system for carrying out the best mode of the invention is shown in a schematic view of a single drawing having a housing for a fluid bed of material being reduced in size for air movement to an outlet in which the housing includes a chevron device for intercepting oversize and hard to reduce material from passing to an outlet.

BRIEF DESCRIPTION OF THE DRAWINGS

The figure illustration an apparatus of the invention for reducing the particle size of material.

DETAIL DESCRIPTION OF THE DRAWING

Figure 1:
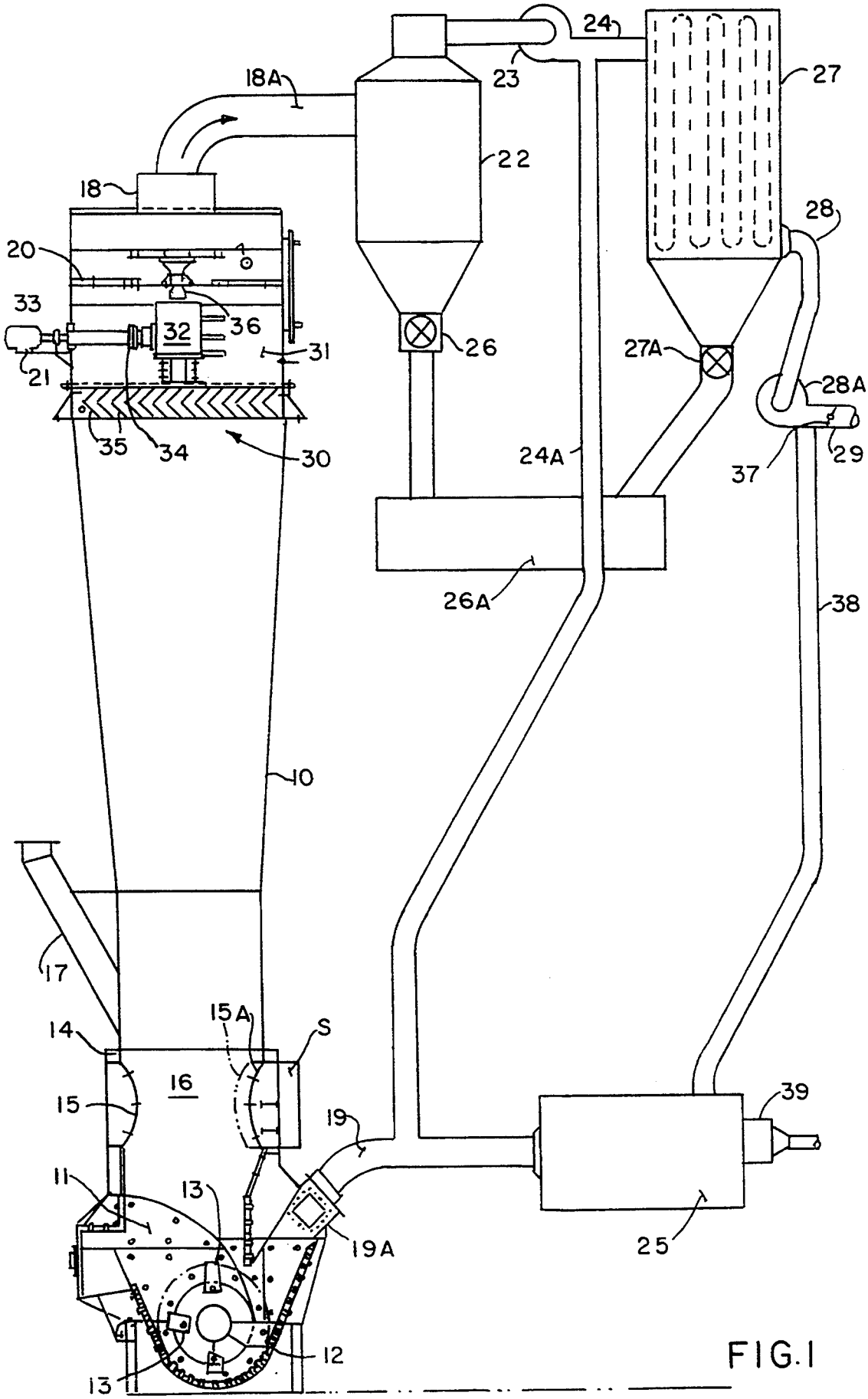

The fluid bed system comprises an elongated column 10 having at its lower end a chamber 11 in which is suitably mounted a material grinding mill characterized by a hammer rotor 12. The material is reduced by being impacted by hammers 13. Spaced above the chamber 11 is a section 14 in the column in which a venturi throat is formed by walls 15 and 15A. The walls 15 and 15A are disposed to define a passage 16 for material flow air moved upwardly in the column 10, while the heavy portions move downwardly into the chamber 11. The wall 15A is manually movable in a support device S to allow for movement to adjust the size of the throat passage 16.

Material to be reduced may be limestone or coal, as well as other material that may or may not be as hard to reduce as limestone or coal. Whatever the material may include, it is introduced at an inlet conduit 17 where it falls into the venturi passage 16. The material having heavy and/or oversize particles will continue to fall and enter the mill chamber 11 where it is impacted by the hammers 13 on rotor 12. The light weight material particles that do not require reduction at this stage will be air lifted up the column 10 toward the outlet 18. The air lift is created in part by air from an external source 19 entering into the mill chamber 11, and by a particle size control internal discharge separator fan blades 20 driven by motor 21. The external air source consists of the air drawn off to a cyclone separator 22 through the fan 23. That air follows conduits 24 and 24A. The gaseous medium from the fan 23 is directed by conduit 24 connected to the bag house 27 where the dust particles of a fineness of about 140 mesh are captured so that the substantially clean and moist air is removed by a blower 28A for discharge at the outlet 29 controlled by a valve 37. The valve is set so that a desired proportion of the moist air can be directed by conduit 38 into the heater 25 to augment the output. The heater 25 is supplied by a suitable fuel (oil or gas) from inlet 39. Conduit 24A leads from fan 23 for connection to a hot gas supply conduit 19 connected to a drying heat source 25 at inlet 19A. That opening 19A leads into the bottom of the chamber 11 where it forms a fluidized bed that will be effective to lift substantially all of the lightweight and air responsive particles toward the outlet 18 at the top of column 10. The air movement through the venturi passage 16 will strip lightweight particles mixed with the heavy particles initially entering at inlet conduit 17 and thereby prevent excessive material reduction. The cyclone separator 22 collects the fine particles and releases them through a rotary valve 26 to the collecting bin 26A which is the product of operating the apparatus.

When the material delivered to the inlet conduit 17 has excessive moisture which would impede effective reduction by the rotor hammers 13, the air supply at inlet 19A can be augmented with hot gas from a heat source 25 or other suitable heat source. It is observed that the fan 28A connects to the conduit 28 which has an exhaust 29 to atmosphere. A control valve 37 regulates the amount of the exhaust in proportion to the hot gas supplied from the source 25. The more gaseous fluid exhausted at valve 37 will allow more air to be drawn in at the heat source 25, thus effectively controlling the exhaust temperature and the dew point in the system.

The apparatus above described is characterized by the placement of a protective and particle size determining chevron member 30 spaced below the top outlet 18 to distribute in space 31 the particles into acceptable size for passage to the outlet 18. The larger particles are centrifugally moved to the side of space 31 near the housing wall to settle by gravity and fall through the chevron member to undergo further reduction. Those particles intercepted by the blades 20 pass reversely through the angularly shaped passages 35 in the chevron member 30 to return to the fluid bed in column 10 and migrate through the venturi 16 for further reduction in the rotor 12. Furthermore, the chevron member 30 intercepts particles that travel at hammer velocity and are not lifted by the fluid bed, thus forcing those particles to return to the rotor 12 for further impact reduction by the hammers 13.

The apparatus is distinguished from the known prior art by the unique chevron member 30 which is constructed to extend across the cross section of the column 10 and present a series of openings or passages of angular character. The shape of the passages offers effective resistance to material that is insufficiently reduced so such material will return to the orbit of the rotary hammers for further reduction. Eventually the reduced material can be fluidized and lifted through the angular passages in the chevron member 30 and rotary blades 20 and pass out through conduit 18A on its way to the cyclone separator 22. The blower 23 at the separator 22 will circulate the air through conduit 24A on its way back to the mill inlet 19A at the rotary hammer mill 12.

The material to be reduced is initially directed into the moving column of air in the column 10 so that any desirable sized fractions will be stripped and immediately move through the sizing assembly in space 31. The material requiring size reduction will either pass directly to the mill, migrate in the fluid bed in column 10 or pass through the angular passage 35. The larger particles impacted by the rotary hammers 13 acquire a significant velocity about equal to the tip speed of the hammers 13 and are able to penetrate and pass through the fluid bed in column 10 to encounter the blockade set up by the angular passages 35 in the chevron member.

It is important from applicant's experience that the rotary speed of the impact hammers in rotary mills of current types develops a considerable level of momentum in most of the material to cause forced passage through the fluid bed in an effort to reach the outlet 18. The preferred and best mode of apparatus is disclosed to accomplish the objective set forth in the improvement defined hereinafter.

It is apparent that modifications and variations may be made to the apparatus described in the specification without exceeding the limits of the invention.

What is claimed is:

1. Material reducing apparatus comprising:

a) a column defining a path for the movement of reduced material;

b) material reducing rotary mill hammers positioned in said column for throwing material out into said column at the tip velocity of the hammers;

c) a reduced material sizing assembly in said column spaced from said material reducing mill hammers and in alignment with the directional path of the material thrown by said hammers;

d) outlet means adjacent said material sizing assembly and on the side thereof remote from said material reducing mill hammers; and e) a structure in said path for reduced material to occupy a position to intercept material thrown at said reduced material sizing assembly, said structure extending across said column to present a series of side by side angularly shaped passages in advance of said material sizing assembly, said passages each defining angularly and interconnecting related passages sized to pass properly reduced material and said angularly shaped passages obstructing the passing of material of an improperly sized reduction, said improperly sized material being thus intercepted for return to said rotary mill.

* * * * *